United States Patent [19]

Dassler

[11] 4,187,623

[45] Feb. 12, 1980

[54] ATHLETIC SHOE

[75] Inventor: Armin A. Dassler, Herzogenaurach, Fed. Rep. of Germany

[73] Assignee: PUMA-Sportschuhfabriken Rudolf Dassler KG, Herzogenaurach, Fed. Rep. of Germany

[21] Appl. No.: 903,567

[22] Filed: May 8, 1978

[30] Foreign Application Priority Data

May 9, 1977 [DE] Fed. Rep. of Germany ..... 2720849

[51] Int. Cl.[2] ..... A43B 5/00; A43B 13/04

[52] U.S. Cl. ..... 36/129; 36/32 R

[58] Field of Search ..... 36/129, 32 R

[56] References Cited

U.S. PATENT DOCUMENTS

| | | | |
|---|---|---|---|
| 1,584,626 | 5/1926 | MacPherson | 36/32 R |
| 2,758,394 | 8/1956 | Whitlock | 36/129 |
| 2,773,316 | 12/1956 | Clappier | 36/129 X |
| 2,985,971 | 5/1961 | Murawski | 36/32 R |
| 3,818,617 | 6/1974 | Dassler et al. | 36/129 X |

FOREIGN PATENT DOCUMENTS

| | | | |
|---|---|---|---|
| 11585 | of 1892 | United Kingdom | 36/32 R |
| 1100994 | 1/1968 | United Kingdom | 36/32 R |

*Primary Examiner*—James Kee Chi

*Attorney, Agent, or Firm*—Becker & Becker, Inc.

[57] ABSTRACT

A lightweight athletic shoe, especially a racing shoe, having a very flexible outer sole of wear-resistant material. The heel section of the outer sole is provided with a heel having such a height that the heel section has a considerably higher position with regard to the forward part of the foot than does an athletic shoe which does not have a heel. When the wearer of the athletic shoe places the heel on the ground, the heel procures for the wearer an acceleration component directed in the direction of movement.

13 Claims, 2 Drawing Figures

ATHLETIC SHOE

The present invention relates to a lightweight athletic shoe, especially a racing shoe, having a highly flexible outer sole of wear-resistant material. The development of athletic shoes, especially racing shoes, football and soccer shoes, handball shoes, basketball shoes, etc., for sport contests, has for a long time been aimed at the achievement of as good a fit as possible at as low a weight as possible. Since the beginning of the development of athletic shoes, this led to the basic requirement of leaving out, as much as possible, parts which, although common with conventional footwear, are not absolutely necessary for an athletic shoe. With athletic shoes of all types for sports contests, the heel is viewed as merely being extra weight. For this reason, athletic shoes for sports contests have for a long time been made without heels.

An exception to this rule are earlier developments of athletic shoes, especially racing shoes, which still had to be made relatively thick due to the at that time still incomplete technology concerning the introduction of spikes into the outer sole without the danger of initiating pressure difficulties. This rather sharply reduced the flexibility of the outer sole. The adapt to the relatively thick outer sole, a heel piece having a thickness corresponding to that of the outer sole was also provided in the heel region. The heel piece in this connection had the further purpose of securing the customary place between the front of the foot and the heel. (German Pat. Nos. 801898, 816512, 879965 and German Gebrauchsmuster 17 10 714)

The recently introduced and extremely lightweight athletic shoes, especially racing shoes, having the known burled or knobby rubber soles or crepe rubber soles with a sole thickness of at the most 1.5 to 1.8 mm, furnish together with the cover or upper an average total weight of at the most 130 g per shoe. In addition to the lightweight construction of the shaft with extremely thin upper material or extremely light fiber webbing, attention was particularly directed towards achieveing a low weight of the shoe welt and the outer sole. With racing shoes, especially for synthetic race courses, it was considered important to take advantage of the catapult effect inherent to modern race courses by means of a more or less expensive refinement of the spike-like gripping elements in the region of the forward sole, even if, to a certain extent, this led to an increased weight of the racing shoe.

It is an object of the present invention to develop an athletic shoe, especially a racing shoe, of the above described general type in such a way that the possibilities, which the rebound effect caused by gravitation offers for acceleration of the athlete, are utilized to a still greater extent.

This object and other objects and advantages of the present invention will appear more clearly from the following specification in connection with the accompanying drawing, in which.

The athletic shoe of the present invention is characterized primarily in that that portion of the outer sole which is associated with the heel section of the shoe is provided with a heel having such a height that the heel section has a considerably higher position with regard to the forward part of the foot than does an athletic shoe which does not have a heel. With this measure, the wearer of the athletic shoe, when placing the heel on the ground, gains an acceleration component directed in the direction of movement.

The invention is based on the knowledge that the athlete, even the sprinter in a short-distance race, no later than the beginning of the fatigue phase, also places the heel on the ground with every step after rolling off of the ball of the foot. With the customary athletic shoes, the distance of the rearward rolling-off process from the balls to the heels is relatively great. This means that a greater amount of time is taken until the heel makes contact with the ground. In addition, due to the low end position of the heel, the rebound effect achieved from the contact with the ground is essentially a component which is only vertical to the running surface or track. This does not contribute at all to the acceleration of the athlete. In contrast, with an athletic shoe of the present invention, the distance of a complete rolling-off cycle of heel to ball to heel is reduced by twice the height of the heel. Due to the higher end position of the heel, the rebound effect generates a resulting acceleration component in the direction of movement. Furthermore, the heel sustains the forward position needed for maintaining the speed or acceleration, and prevents in particular the stumbling which is feared during the final spurt and is caused by fatigue, and which results in a loss of time. These surprising advantages are so considerable that compared to the somewhat greater weight (with racing shoes the additional weight for the heel can be held to less than 5 g per shoe) has absolutely no significance, as evidenced by thorough testing.

Figure 1:
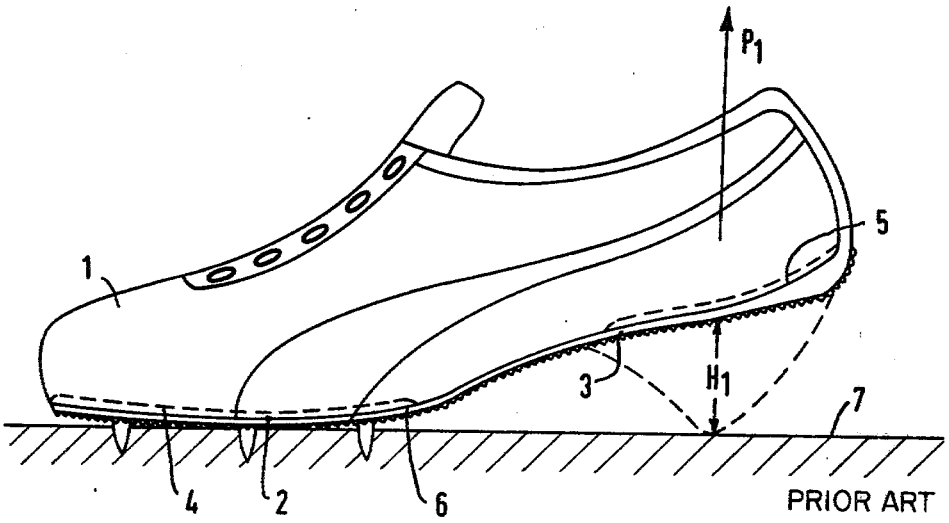
PRIOR ART Fig. 1
FIG. 1 is a side view of a customary lightweight racing shoe.

Referring now to the drawing in detail, the known racing shoe of FIG. 1 comprises a covering or upper 1 which is kept as light as possible and is made of leather or a fiber webbing or mesh, preferably of a polyamide base. The welt pieces 4 and 5 are located in the region of the forward sole 2 and the heel 3. The knobby rubber soles or crepe rubber soles 6, which are of wear-resistant material and preferably extend from the forward sole 2 to the heel 3, have a thickness of 1.5 to 1.8 mm. FIG. 1 shows the rolling-off process in nearly the end phase with regard to the balls of the shoe. The distance which the heel must travel in order to achieve contact with the ground (see the dashed lines in FIG. 1) is shown through the middle of the heel as $H_1$. Since the heel 3, upon reaching the ground 7, has a relatively low end position, the rebound effect caused by contact with the ground generates essentially only one component, which is approximately perpendicular to the running surface and is shown by the arrow $P_1$. In this instance, the rebound effect does not contribute to acceleration of the athlete.

Figure 2:
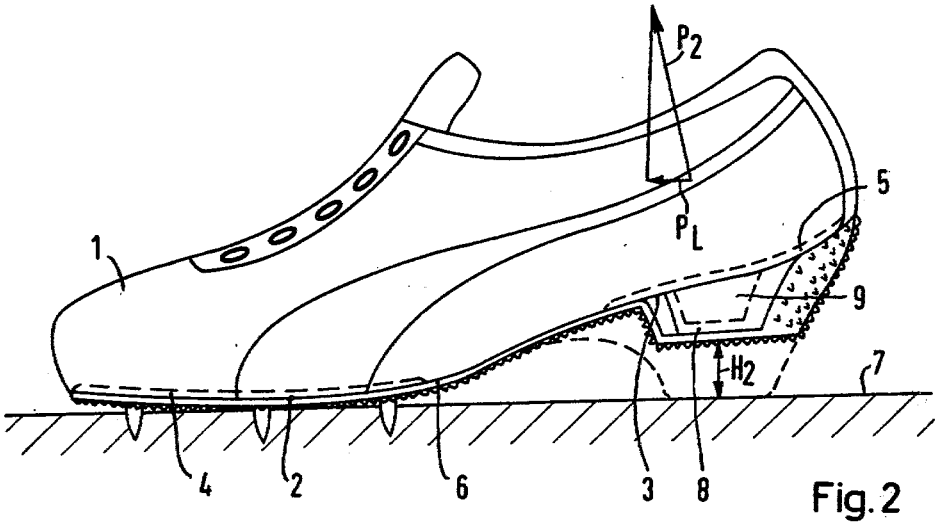
FIG. 2 is a side view of a lightweight racing shoe according to the present invention.

The racing shoe of the present invention is shown in FIG. 2. Those parts which are the same as in FIG. 1 have the same reference numerals. As can be clearly seen from the drawing, the racing shoe of the present invention, in the region of the heel, has a distinct heel section 8, which is preferably inserted as a separate piece between the welt 5 and the outer sole 6, and is preferably glued to these parts. When making the athletic shoe as a racing shoe, the heel preferably comprises a flexible elastic yet relatively slightly volume compressible material. Solid rubber is particularly suitable for this purpose. However, other light rubbers or porous materials may be used. When making the athletic shoe of the present invention as a racing shoe, the height of the heel is preferably between 10 mm and 20 mm. In so doing, one obtains a height $H_2$ between the lower free end of the heel 8 and the ground 7, which height is less than the height $H_1$ of the known style of FIG. 1 by an amount equal to the height of the heel. The distance, and therewith the time, for the rearward rolling-off process of ball to heel is correspondingly considerably reduced with the athletic shoe of the present invention in comparison to the known athletic shoe. For optimum utilization of the rebound effect it is also advantageous if the step or tread surface of the heel 8 is kept as large as possible, at least 30 mm by 30 mm, preferably, however, more than 40 mm by 40 mm. In order to reduce the weight of the already lightweight material of the heel 8 still further, it may be advantageous if the heel 8 is provided with a hollow section 9 which is preferably open toward the foot side. In this case, the welt piece 5 can be eliminated in the region of the heel 3. It is sufficient if the knobby rubber sole or crepe rubber sole 6 covers the running surface of the heel 8. A covering on the side surfaces of the heel is not necessary, and for the purpose of weight, is also not expedient.

Naturally, it is not necessary that the knobby rubber sole or the crepe rubber sole 6 extend over the entire running surface of the racing shoe. In the forward sole region 2, a known soleplate or polyamide and claw-like gripping elements may also be provided. Such a design is particularly suitable for synthetic race courses.

The present invention is, of course, not restricted to use as racing shoes, but is also suitable for any other athletic shoe for any other type of contest, especially for football and soccer shoes, handball shoes, tennis shoes, basketball shoes, etc.

With athletic shoes provided with supports or knobs, such as football and soccer shoes, it is expedient if the heel 8 comprise hard rubber, or some other material which is secure against being punctured, in order to avoid pressure points caused by the supports or knobs. With this type of design, heel heights of 8 mm to 10 mm are sufficient and advantageous. Also, such an increase of the heel already supports the forward position of the player or athlete, which forward position is desired for quick accelerations or for slowing down very fast.

It is important that the heel 8 provided in the heel region 3 not impair the flexibility of the outer sole 6, as is the case with known wedge-shaped sole reinforcers, which extend from the heel up to the ball section of the shoe, and are particularly known with jumping shoes. Such a heel or wedge, which is extended toward the front, would not be expedient when using the present invention for races, especially sprints.

Due to the small distance $H_2$ between the lower heel surface and the ground 7 during the rearward rolling-off process of balls 2 to heel 3, and the relatively large heel surface, one obtains a pronounced rebound effect, which generates a force component $P_2$ which extends at an angle to the contact surface 7 with a resulting accelerating force component $P_L$ in the direction of running.

The heel 8 can, of course, also be integrated with the outer sole. The opportunity for doing this is particularly presented with sprayed soles, such as polyamide soles for football and soccer shoes. In this case also, if necessary, the weight-saving hollow section or recess 9 can be cast-in during the course of manufacture.

The present invention is, of course, in no way limited to the specific showing of the drawing, but also encompasses any modifications within the scope of the appended claims.

What I claim is:

1. A lightweight athletic racing shoe, which comprises in combination:

a very flexible outer sole, of wear-resistant material, having a forward sole region with gripping elements as well as a heel section with a clearly elevated position occupied with respect to the forward sole region; and a heel associated with said heel section of said outer sole, the height of said heel being sufficient to impart to the wearer of said athletic racing shoe, when the wearer during forward movement places said heel on the ground, an acceleration component directed in the direction of said movement.

2. An athletic racing shoe according to claim 1, in which a welt is provided in the heel section of said outer sole, and in which said heel is a separate piece inserted between said welt and said outer sole.

3. An athletic racing shoe in combination according to claim 1, in which said heel is made of flexible, elastic material which is only relatively slightly volume compressible.

4. An athletic racing shoe in combination according to claim 3, in which said elastic material is solid rubber.

5. An athletic racing shoe in combination according to claim 1, in which said outer sole is provided with knobs and said heel comprises hard rubber.

6. An athletic racing shoe in combination according to claim 1, in which said heel has a height of more than 8 mm.

7. An athletic racing shoe in combination according to claim 6, in which said heel has a height of 10–20 mm.

8. An athletic racing shoe in combination according to claim 1, in which said heel has a surface for contact with the ground of at least 30 mm by 30 mm.

9. An athletic racing shoe in combination according to claim 8, in which said heel has a contact surface with the ground of more than 40 mm by 40 mm.

10. An athletic racing shoe in combination according to claim 1, in which said heel is provided with a hollow section.

11. An athletic racing shoe in combination according to claim 10, in which said hollow section is open toward the foot side of said shoe.

12. An athletic racing shoe in combination according to claim 1, in which at least that surface of said heel which is intended for contact with the ground is covered with wear-resistant material.

13. An athletic racing shoe in combination to claim 12, in which said wear-resistant material is selected from the group consisting of knobby rubber sole material and crepe rubber sole material.

* * * * *